US011261557B2

(12) United States Patent
Jang et al.

(10) Patent No.: US 11,261,557 B2
(45) Date of Patent: Mar. 1, 2022

(54) LAUNDRY TREATMENT APPARATUS AND METHOD FOR ASSEMBLING THE SAME

(71) Applicant: LG Electronics Inc., Seoul (KR)

(72) Inventors: Donggyu Jang, Seoul (KR); Unkeol Yeo, Seoul (KR); Hyeonbin Im, Seoul (KR)

(73) Assignee: LG Electronics Inc., Seoul (KR)

( * ) Notice: Subject to any disclaimer, the term of this patent is extended or adjusted under 35 U.S.C. 154(b) by 90 days.

(21) Appl. No.: 16/584,243

(22) Filed: Sep. 26, 2019

(65) Prior Publication Data

US 2020/0102683 A1 Apr. 2, 2020

(30) Foreign Application Priority Data

Sep. 28, 2018 (KR) ..... 10-2018-0116414

(51) Int. Cl.
*D06F 37/24* (2006.01)
*D06F 23/04* (2006.01)
*D06F 37/12* (2006.01)

(52) U.S. Cl.
CPC ..... *D06F 37/245* (2013.01); *D06F 23/04* (2013.01); *D06F 37/12* (2013.01); *D06F 37/24* (2013.01)

(58) Field of Classification Search
CPC ..... D06F 23/04; D06F 37/12; D06F 37/24; D06F 37/245; D06F 37/261; D06F 37/263; D06F 37/267
See application file for complete search history.

(56) References Cited

U.S. PATENT DOCUMENTS

2010/0326141 A1 12/2010 Chung
2011/0247373 A1* 10/2011 Sharp ..... D06F 23/04 68/131

(Continued)

FOREIGN PATENT DOCUMENTS

CN 2432229 5/2001
CN 3818048 9/2006

(Continued)

OTHER PUBLICATIONS

Australian Office Action in Australian Application No. AU2019236741, dated Jun. 4, 2020, 9 pages.

(Continued)

*Primary Examiner* — Joseph L. Perrin
(74) *Attorney, Agent, or Firm* — Fish & Richardson P.C.

(57) ABSTRACT

A laundry treatment apparatus includes a cabinet, a tub, a drum, a balancer, and a coupling part. The tub defines a tub opening, and the drum includes a body rotatably disposed in the tub and defines a drum opening configured to communicate with the tub opening. The balancer includes a housing having in a ring shape and defining a circulation passage configured to circulate fluid circulate along a circumference of the housing and a housing through-hole configured to communicate with the drum and tub openings. The balancer further includes a fastening part arranged along a circumferential surface of the housing and coupled to the body. The coupling part is disposed at an upper end of the body, coupled to the fastening part along an outer circumferential surface of the fastening part, and curved or bent toward a central of the housing.

16 Claims, 7 Drawing Sheets

(56) References Cited

U.S. PATENT DOCUMENTS

| | | | | |
|---|---|---|---|---|
| 2012/0144875 | A1* | 6/2012 | Kim | F16F 15/363 68/13 R |
| 2016/0145789 | A1* | 5/2016 | Kim | D06F 37/245 68/171 |
| 2016/0160421 | A1* | 6/2016 | Alexander | D06F 37/245 74/572.4 |
| 2016/0258103 | A1* | 9/2016 | Hunnell | D06F 37/26 |
| 2018/0237972 | A1* | 8/2018 | Lv | D06F 37/02 |
| 2019/0203397 | A1* | 7/2019 | Ryu | D06F 37/12 |

FOREIGN PATENT DOCUMENTS

| | | |
|---|---|---|
| CN | 203530693 | 4/2014 |
| CN | 106032624 | 10/2016 |
| KR | 1019990031041 | 5/1999 |
| KR | 200327063 | 9/2003 |
| WO | WO2015058956 | 4/2015 |
| WO | WO2019165897 | 9/2019 |

OTHER PUBLICATIONS

[No Author Listed] [online], "Balance ring Video #1," Systems Unlimited Inc., Sep. 10, 2014, retrieved on Nov. 25, 2020, Internet Archive: Wayback Machine URL <https://web.archive.org/web/20210208203301if_/https://www.youtube.com/watch?v=jB_yxGHrBCs> retrieved on Feb. 10, 2021, <https://www.youtube.com/watch?v=jB_yxGHrBCs> , 2 page [video submission].

AU Office Action in Australian Appln. No. 2019236741, dated Dec. 15, 2020, 9 pages.

CN Office Action in Chinese Appln. No. 201910918181.9, dated Jul. 5, 2021, 19 pages (with English translation).

* cited by examiner

LAUNDRY TREATMENT APPARATUS AND METHOD FOR ASSEMBLING THE SAME

CROSS-REFERENCE TO RELATED APPLICATIONS

This application claims the benefit of Korean Patent Application No. 10-2018-0116414, filed on Sep. 28, 2018, the disclosure of which is hereby incorporated by reference as if fully set forth herein.

BACKGROUND OF THE INVENTION

Field of the Invention

The present disclosure relates to a laundry treatment apparatus and a method for assembling the same, and more particularly to a laundry treatment apparatus provided with a balancer and a method for assembling the laundry treatment apparatus provided with the balancer.

Discussion of the Related Art

A conventional laundry treatment apparatus includes a cabinet forming an external appearance thereof, a tub installed in the cabinet so as to store water therein, and a drum rotatably installed in the tub so as to clean laundry. However, the drum may be eccentrically rotated without implementing dynamic equilibrium or dynamic balance according to the position of laundry contained in the drum. Dynamic equilibrium or dynamic balance may refer to a specific situation in which either centrifugal force produced by rotation of a rotary body or the sum of moments produced by the centrifugal force is set to zero '0' about a rotary shaft. In case of rotating a rigid body, dynamic equilibrium or dynamic balance of the rotating rigid body can be maintained in the situation in which mass distribution of the rotating rigid body is uniform about the rotary shaft. However, if the above-mentioned ideal situation is not provided and the laundry treatment apparatus in which eccentric rotation of the drum unavoidably occurs is used, vibration may unavoidably occur in the drum due to an unbalance state caused by broken dynamic equilibrium and the vibration may be transmitted to the tub or cabinet, resulting in occurrence of noise.

In order to address the above issues, although a damper and a spring can be installed outside the tub, a balancer may be arranged at any of positions, for example, an upper part, a center part, or a lower end of the drum. A circulation passage may be disposed in the balancer, and a balance part (such as a ball or liquid) capable of circulating in the circulation passage may also be disposed in the balancer, resulting in formation of the resultant balancer. In this case, a method for controlling the balance part installed in the balancer to move in a direction opposite to the direction of eccentric movement caused by movement of laundry within the drum during movement of a rotation trajectory of the drum may be used to control such unbalance. Conventionally, in order to couple such balancer to the upper end of the drum, a fastening method using screws has been used. That is, after the lower end of the balancer is inserted into the top end of the drum, the top end of the drum (i.e., the top end of the body forming a body frame of the drum) may be screw-coupled to a lower part of the balancer.

However, whereas the conventional screw-fastening method can strongly and tightly couple the balancer to the drum using several screws, such screw-coupling can be easily released due to rotation, stoppage, switching, and vibration of the drum. If screw-coupling is released, the conventional screw-fastening method may cause internal constituent elements of the laundry treatment apparatus to be damaged or broken. In addition, an assembly time for screw-fastening increases, resulting in reduction in productivity.

SUMMARY OF THE INVENTION

Accordingly, the present disclosure is directed to a laundry treatment apparatus and a method for assembling the same that substantially obviate one or more problems due to limitations and disadvantages of the related art.

An object of the present disclosure is to provide a laundry treatment apparatus which does not couple a balancer to an upper end of a drum using one or more screws, includes a protrusion formed at an outer surface of the balancer, bends the upper end of the drum, and couples the bent upper end of the drum to the protrusion, resulting in formation of the laundry treatment apparatus.

Another object of the present disclosure is to provide a laundry treatment apparatus provided with a balancer formed by deformation (redesign) of the protrusion so as to prevent the protrusion of the balancer from being damaged by problems encountered when the balancer is coupled to the upper end of the drum according to the above-mentioned bending-coupling method. For example, the above problems may include slippage caused by rotation, stoppage, switching or vibration of the drum due to loose connection between the balancer and the upper end of the drum, and damage of the protrusion of the balancer due to occurrence of bending-and-coupling force.

Another object of the present disclosure is to provide an assembly method for bending the upper end of the drum to be suitable for the outer surface of the balancer using a roller in a manner that the bent upper end of the drum is coupled to the outer surface of the balancer, and a laundry treatment apparatus using the assembly method.

Another object of the present disclosure is to provide a laundry treatment apparatus, in a situation in which damage or malfunction of connection between the balancer and the upper end of the drum occurs so that the balancer and the upper end of the drum are not fixed, configured to be used without replacement of the balancer.

Additional advantages, objects, and features of the present disclosure will be set forth in part in the description which follows and in part will become apparent to those having ordinary skill in the art upon examination of the following or may be learned from practice of the present disclosure. The objectives and other advantages of the present disclosure may be realized and attained by the structure particularly pointed out in the written description and claims hereof as well as the appended drawings.

To achieve these objects and other advantages and in accordance with the purpose of the present disclosure, as embodied and broadly described herein, a laundry treatment apparatus includes a cabinet, a tub, a drum, a balancer, and a coupling part. The cabinet includes an inlet. The tub is disposed in the cabinet to provide a space in which water is stored, and includes an tub opening formed to communicate with the inlet. The drum includes a body rotatably disposed in the tub to provide a space in which laundry is stored, an drum opening formed to communicate with the tub opening, and a body through-hole disposed to pass through the body. The balancer includes a housing formed in a ring shape, a housing through-hole formed to pass through the housing while simultaneously communicating with the tub opening and the drum opening, a circulation passage disposed in the housing, fluid provided to circulate along the circulation passage, and a fastening part arranged along a circumferential surface of the housing, and coupled to the body. The coupling part located at an upper end of the body, and configured to be bent in a radial direction of the housing along an outer circumferential surface of the fastening part such that the coupling part is coupled to the fastening part.

The fastening part may protrude from an outer circumferential surface of the housing to a circumferential direction of the housing, and may be accommodated in the upper end of the body. The coupling part may be bent in a radial direction of the housing along the outer circumferential surface of the fastening part.

The fastening part may include a first fastening part formed by a top surface of the fastening part, a second fastening part formed by a side surface of the fastening part, a third fastening part formed by a bottom surface of the fastening part, a fourth fastening part formed to extend from an inner end of the third fastening part, and a fifth fastening part formed to extend from an end of the fourth fastening part to a bottom surface of the housing. The coupling part may include a first coupling part formed to contact the first fastening part, a second coupling part formed to extend from the first coupling part, and configured to contact the second fastening part, and a third coupling part formed to extend from the second coupling part, and configured to contact the third fastening part, the fourth fastening part, and the fifth fastening part. The third coupling part may include a first curved part formed to contact the third fastening part and the fourth fastening part, a planarization part formed to extend from the first curved part so as to contact the fifth fastening part, and a second curved part formed to extend from the planarization part so as to contact the body of the drum.

The end part of the first coupling part that is bent and coupled in a radial direction of the housing along an outer circumferential surface of the fastening part may be spaced apart from an outer circumferential surface of the housing by a predetermined separation distance.

At least one of contact between the first fastening part and the first coupling part, contact between the second fastening part and the second coupling part, and contact between the fifth fastening part and the planarization part may be surface-contact.

The first curved part may be formed in a curved shape such that both ends of the first curved part contact each of the third fastening part and the fourth fastening part.

The fastening part may include at least one protrusion to prevent slippage between the fastening part and the coupling part. The fastening part may have the same shape as the first coupling part to be coupled to the fastening part.

The protrusion may include a first contact part formed to extend from the fastening part, and configured to protrude in a height direction of the housing, a second contact part formed to extend from an end part of the first contact part, and configured to protrude in a direction parallel to a circumferential direction of the housing, and a third contact part formed to extend from an end part of the second contact part, and formed to protrude in the height direction of the housing such that the third contact part is in contact with the fastening part.

The first contact part may be tilted upward in a manner that the first contact part is in contact with the second contact part.

The third contact part may be tilted downward in a manner that the second contact part is connected to the first fastening part by the third contact part.

When the coupling part is bent and coupled to the fastening part, the fastening part may be damaged by external force. The laundry treatment apparatus may further include at least one reinforcement rib formed to protrude from the third fastening part so as to prevent damage of the fastening part, configured to extend in a direction from the housing to the drum, and connected to the housing.

The reinforcement rib may be formed in a tapered shape. The tapered shape may be configured in a manner that, as the reinforcement rib moves closer from an outer circumferential surface of the drum to an inner circumferential surface of the tub, a height of the reinforcement rib starting from a contact surface where the reinforcement rib contacts the third fastening part is gradually reduced.

Specifically, in the region in which the protrusion is contained, it is impossible for the reinforcement rib to have the same size as the reinforcement rib of the third fastening part in which the protrusion is not contained. The protrusion may include at least one protrusion reinforcement rib formed to protrude by contacting the second contact part and the housing by a predetermined length that is equal to or shorter than a length of the second contact part in a radial direction so as to prevent damage of the protrusion.

In the same manner as in the reinforcement rib, as the distance from the circumferential surface of the drum to an external part of the drum gradually increases, a height of the protrusion reinforcement rib is gradually reduced.

In addition, when the balancer is not fixed due to damage of the fastening part or the coupling part, the laundry treatment apparatus is unable to normally operate. In this case, the balancer or the drum can be replaced. The fifth fastening part may include at least one screw-fastening part such that the coupling part is screw-coupled to the fastening part.

The coupling part may include at least one screw-hole that passes through the planarization part and communicates with the screw-fastening part such that the coupling part is screw-coupled to the fastening part.

In accordance with another aspect of the present disclosure, a method for assembling a laundry treatment apparatus which includes a cabinet provided with an inlet, a tub disposed in the cabinet to provide a space in which water is stored, and provided with an tub opening formed to communicate with the inlet, a drum including a body rotatably disposed in the tub to provide a space in which laundry is stored, an drum opening formed to communicate with the tub opening, and a body through-hole disposed to pass through the body, a balancer including a housing formed in a ring shape, a housing through-hole formed to pass through the housing while simultaneously communicating with the tub opening and the drum opening, a circulation passage disposed in the housing, fluid provided to circulate along the circulation passage, and a fastening part arranged along a circumferential surface of the housing, and coupled to the body, and a coupling part located at an upper end of the body, and configured to be bent in a radial direction of the housing along an outer circumferential surface of the fastening part such that the coupling part is coupled to the fastening part, the method includes a first step in which the balancer is inserted through the drum opening, and a second step in which the coupling part is bent in a radial direction along the fastening part of the balancer so that the coupling part is coupled to the fastening part.

The second step may include bending the coupling part so that the bent coupling part is coupled to the fastening part using at least one of a roller rotating in the same direction as a rotary shaft of the drum and another roller rotating in another direction different from that of the rotary shaft of the drum.

The fastening part may include a first fastening part formed by a top surface of the fastening part and a second fastening part formed by a side surface of the fastening part. The coupling part may include a first coupling part contacting the first fastening part and a second coupling part extending from the first coupling part so as to contact the second fastening part. The second step may include performing, when the coupling part is bent and coupled to the fastening part, surface-contact between the first fastening part and the first coupling part and surface-contact between the second fastening part and the second coupling part.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the present disclosure and are incorporated in and constitute a part of this application, illustrate embodiment(s) of the present disclosure and together with the description serve to explain the principle of the present disclosure. In the drawings.

DESCRIPTION OF SPECIFIC EMBODIMENTS

Figure 1:
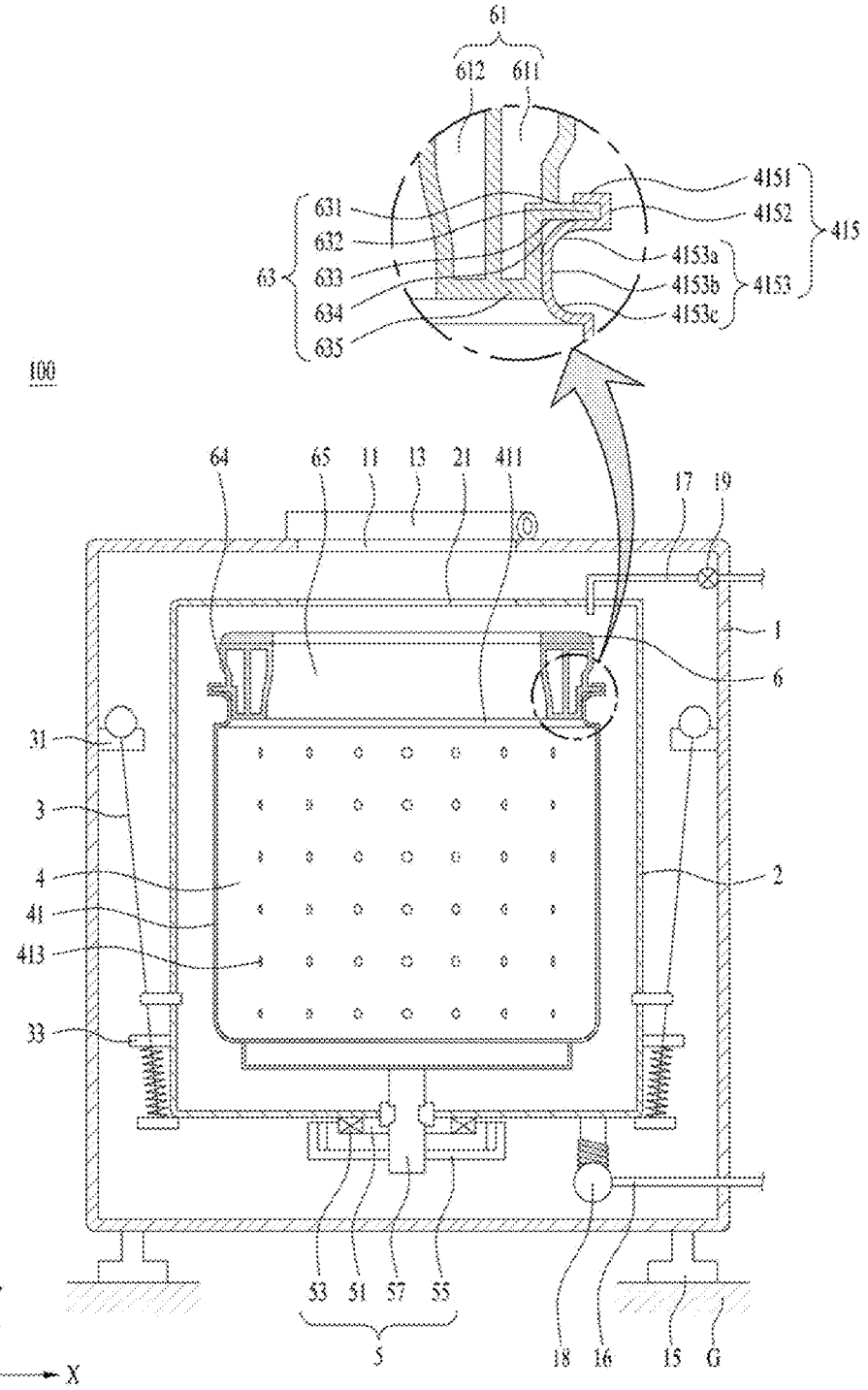
FIG. 1 is a side schematic view illustrating an example of a laundry treatment apparatus and a cross-sectional view illustrating an example of a connection between a fastening part of a balancer and a coupling part of a body according to the present disclosure.

Reference will now be made in detail to the embodiments of the present disclosure, examples of which are illustrated in the accompanying drawings. The following device and assembly method may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

Referring to FIG. 1, the laundry treatment apparatus 100 according to the present disclosure may include a cabinet 1, a tub 2, a drum 4, a balancer 6, a fastening part 63, and a coupling part 415. The cabinet 1 may include an inlet 11. The tub 2 may be disposed in the cabinet, and may include a tub opening 21 (or a tub inlet) forming a water storage space. The drum 4 may include a body 41 rotatably installed in the tub 2 so as to store the laundry, and a body through-hole 413 formed to pass through the body 41. The balancer 6 formed in a ring shape may reduce noise and vibration by reducing unbalance of the drum 4. The fastening part 63 may be provided in the balancer 6. The coupling part 415 formed at the upper end of the body 41 may be bent in a radial direction of the balancer 6 along an outer circumferential surface of the fastening part, so that the coupling part 415 can be coupled to the fastening part 63. The coupling part 415 may have a curled or curved shape.

The cabinet 1 may include an inlet 11 through which laundry can be supplied to the drum 4 and the laundry can be taken out of the drum 4. The inlet 11 may include a door 13 rotatably installed in the cabinet 1.

An adjustment part 15 may be installed at the bottom surface of the cabinet 1. The adjustment part 15 may adjust the height or a horizontal plane of the cabinet 1 with respect to the ground (G) corresponding to the bottom surface of the space in which the laundry treatment apparatus will be installed.

The tub 2 may be provided in any of shapes in which water can be stored. The tub 2 may receive water through water-supply parts 17 and 19, and may discharge water to the outside of the cabinet 1 through drain parts 16 and 18. Preferably, the tub 2 may be formed in a cylindrical shape. The water-supply part may include a water-supply pipe connected to a water-supply source, and a valve 19 for opening or closing the water-supply pipe. The drain part may include a pump 18 for discharging water stored in the tub 2 to the outside of the tub 2, and a drain pipe 16 for guiding water pressurized by the pump to the outside of the cabinet 1.

The tub 2 may include a tub opening 21 formed to communicate with the inlet 11, and may be fixed into the cabinet 1 through a tub support part 3. Preferably, the tub support part 3 may be formed to absorb vibration generated in the tub 2.

In other words, the tub support part 3 may include a first support part 31 provided in the cabinet 1, a second support part 33 provided in the tub 2, and a bar through which the first support part 31 is connected to the second support part 33, such that vibrations applied to the tub 2 can be offset against each other by a compression spring. The tub support part 3 may further include a damper and the like to effectively reduce (or attenuate) noise.

The drum 4 may be implemented as the body 41 that is installed in the tub 2 and stores laundry. The body 41 may rotate in the tub 2 by a driver 5, such that it is preferable that the body 41 be formed in a cylindrical shape.

The body 41 may include a drum opening 411 that is located in the same direction as the tub opening 21 of the tub 2. A circumferential surface of the body 41 may be provided with at least one through-hole 413 through which water supplied to the tub 2 can flow into the body 41.

The balancer 6 may include a ring-shaped housing 64, a housing through-hole 65, a circulation passage 61, fluid, and a fastening part 63. The ring-shaped housing 62 may be fixed to an upper end of the body 41. The housing through-hole 65 may be formed to pass through the housing 64, and may communicate with the drum opening 411 and the tub opening 21. The circulation passage 61 may be provided in the housing 64. The fluid may circulate along the circulation passage. The fastening part 63 may be provided along the circumferential surface of the housing 64, and may be coupled to the body 41.

The upper end of the body 41 may be bent in a radial direction of the housing 64 according to the outer circumferential surface of the fastening part 63, resulting in formation of the coupling part 415.

The housing 64 may be formed in a ring shape by assembling an upper housing to a lower housing. In addition, according to the method for assembling the balancer 6, various pieces may be combined in a manner that the housing 64 can be formed in the ring shape. The housing 64 may include a balance part (such as a solid or liquid) movable within the circulation passage 61. When a solid movable in the circulation passage 61 is used as the balance part, the housing 64 may be formed in a ball shape. When liquid movable in the circulation passage 61 is used as the balance part, water, high-density aqueous solution (salt water, etc.) or high-viscosity viscous fluid, etc. may be used as the liquid.

In addition, in order to calibrate the noise reduction and vibration attenuation function of the balancer 6 according to types of laundry, the balance part for use in the housing 64 can be replaced or supplemented. To this end, the housing 64 may include a means for replacing or supplementing the balance part. The circulation passage 61 of the balancer 6 may be formed in various shapes, and may be implemented as a plurality of circulation passages as needed.

The laundry treatment apparatus 100 according to the present disclosure may be implemented as any of a top loading laundry treatment apparatus in which the inlet 11 is located at a top surface of the cabinet 1 and a front loading laundry treatment apparatus in which the inlet 11 is located at a front side of the cabinet 1. FIG. 1 is a view illustrating the laundry treatment apparatus 100 implemented as the top loading laundry treatment apparatus. In this case, the inlet 11 may be located at the top surface of the cabinet 1, the tub opening 21 may be located at the top surface of the tub 2, and the drum opening 411 of the drum body 41 may be located at the top surface of the body 41. The balancer 6 should be provided at the upper end of the body 41.

The driver 5 provided in the top loading laundry treatment apparatus 100 may include a stator 53, a rotor 55, a rotary shaft 51, and a shaft support part 57. The stator 53 may be fixed to an outer bottom surface of the tub 2, and may form a rotational magnetic field. The rotor 55 may rotate by the rotational magnetic field. The rotary shaft 51 may be provided to pass through the bottom surface of the tub 2, and may couple the rotor 55 to the body 41. The shaft support part 57 may be provided in the tub 2 so that the rotary shaft 51 can be rotatably supported.

Meanwhile, when the laundry treatment apparatus is implemented as the front loading laundry treatment apparatus, the inlet 11, the tub opening 21, and the drum opening 411 may be located at the front side of the cabinet 1, the front side of the tub 2, and the front side of the body 41, respectively. There is a need for the balancer 6 to be provided at the front side of the body 41. In this case, the body 41 of the drum should be arranged in a manner that the rotary shaft is arranged parallel to the ground G. There is a need for the driver 5 of the laundry treatment apparatus 100 to be composed of the stator, the rotary shaft, and the shaft support part. The stator may be fixed to a rear outer surface of the tub. The rotary shaft may connect the body to the rotor by passing through the rear side of the tub. The shaft support part may be provided in the tub and may rotatably support the rotary shaft.

The laundry treatment apparatus may perform a washing process and a dehydration process. In the washing process, after water is supplied to the laundry treatment apparatus through the water-supply parts 17 and 19, the drum 4 may rotate through the driver 5 so that laundry contained in the drum 4 can be washed and rinsed using a vortex flow of water. In the dehydration process, water may be drained outside the tub 2 through the drain parts 16 and 18, and the drum 4 may rotate through the driver 4, such that laundry can be dehydrated. The laundry treatment apparatus may further include a controller for the washing process and the dehydration process.

The enlarged cross-sectional view of FIG. 1 illustrates an example of a connection between the fastening part 63 of the balancer 6 and the coupling part 415 of the body 41. In the enlarged cross-sectional view, the circulation passage 61 may be implemented as two circulation passages (i.e., a first circulation passage 611 and a second circulation passage 612) such that the first and second circulation passages 611 and 612 can more effectively regulate an unbalance state than the other case in which only one circulation passage is used.

The conventional screw-fastening method for coupling the balancer 6 to the body 41 using screws has disadvantages in that such screw-coupling is released due to high-speed rotation of the drum 4, such that other constituent elements other than the balancer 6 and the body 41 may be broken or damaged and a long assembly time may be taken to interconnect the balancer 6 and the body 41. In order to address the above-mentioned issues, the fastening part 63 where the balancer 6 meets and connects to the body 41 may protrude outward from the outer circumference of the housing 64, and may be accommodated in the upper end of the body 41. The coupling part 415 located at the upper part of the body 41 may be bent toward a central direction of the housing 64 along the outer circumferential surface of the fastening part 63, so that the bent coupling part 415 can be connected to the fastening part 63. The enlarged cross-sectional view of FIG. 1 is an example of such connection.

The above-mentioned embodiment will hereinafter be described with reference to the attached drawings. The above-mentioned connection may include a first fastening part 631 formed by a top surface created by protrusion of the fastening part 63, a second fastening part 632 formed by a side surface of the fastening part 63, a third fastening part 633 formed by a bottom surface of the fastening part 63, a fourth fastening part 634 extending from an inner end of the third fastening part 633, and a fifth fastening part 635 extending from the end of the fourth fastening part 634 to the bottom surface of the housing 64. The coupling part 415 may include a first coupling part 4151, a second coupling part 4152, and a third coupling part 4153. The first coupling part 4151 may contact the first fastening part 631. The second coupling part 4152 may extend from the first coupling part 4151, and may thus contact the second fastening part 632. The third coupling part 4153 may extend from the second coupling part 4152, and may thus contact the third fastening part 633, the fourth fastening part 634, and the fifth fastening part 635. The third coupling part 4153 may include a first curved part 4153*a*, a planarization part 4153*b*, and a second curved part 4153*c*. The first curved part 4153*a* may be in contact with the third fastening part 633 and the fourth fastening part 634. The planarization part 4153*b* may extend from the first curved part 4153*a*, and may thus contact the fifth fastening part 635. The second curved part 4153*c* may extend from the planarization part 4153*b*, and may thus contact the body 41.

In this case, the coupling part 415 may be bent toward the central direction of the housing 64 along the outer circumferential surface of the fastening part 63, such that the bent coupling part 415 can be coupled to the fastening part 63. Such coupling may be classified into simple connection and tight connection according to bending force levels. Specifically, at least one of contact between the first fastening part 631 and the first coupling part 4151, contact between the second fastening part 632 and the second coupling part 4152, and contact between the fifth fastening part 635 and the planarization part 4153*b* may be surface-contact. The first curved part 4153*a* may contact the third fastening part 633 and the fourth fastening part 634. In this case, only both ends of the first curved part 4153*a* may contact the fourth fastening part 634, and the remaining parts of the first curved part 4153*a* may be smoothly curved. In order to prevent damage of a connection between the fastening part 63 and the coupling part 415 in consideration of the reinforcement rib 6331 to be described later, when the balancer 6 is accommodated in the upper end of the body 41, the above-mentioned coupling structure may serve as a guide.

In addition, the end of the first coupling part 4151 and the outer circumference of the housing 64 may be spaced apart from each other by a predetermined distance. Here, the first coupling part 4151 may be bent toward a central direction of the housing 64 along the outer circumferential surface of the fastening part 63. As a result, when the fastening part 63 is coupled to the coupling part 415, occurrence of the housing 64 damaged by the end of the first coupling part 4151 can be prevented.

When the coupling part 415 is bent toward a central direction of the housing 64 along the outer circumferential surface of the fastening part 63 and is then connected to the fastening part 415, such connection between the coupling part 415 and the fastening part 415 is incompletely achieved, such that slippage between the fastening part 63 and the coupling part 415 may occur. It is impossible for the balancer 6 to normally operate due to slippage between the balancer 6 and the body 41. In severe cases, the balancer 6 or the body 41 may be broken or damaged.

In order to prevent the slippage problem, the fastening part 631 may include at least one protrusion 5311, and the first coupling part 4151 to be coupled to the fastening part 63 may have a shape corresponding to the fastening part 63. That is, unevenness may be formed to prevent such slippage. Although the first coupling part 4151 can be pre-molded to have a shape corresponding to the protrusion 6311 of the first fastening part, the first coupling part 4151 may be formed to have a shape corresponding to the protrusion 6311 in the above process of bending and coupling the first fastening part 631. As a result, in the assembly process (rolling-based fabrication) for allowing the first coupling part 4151 to be in closer contact with the first fastening part 631, the above-mentioned shape of the first coupling part 4151 can be naturally formed in a pressed manner.

Figure 2:
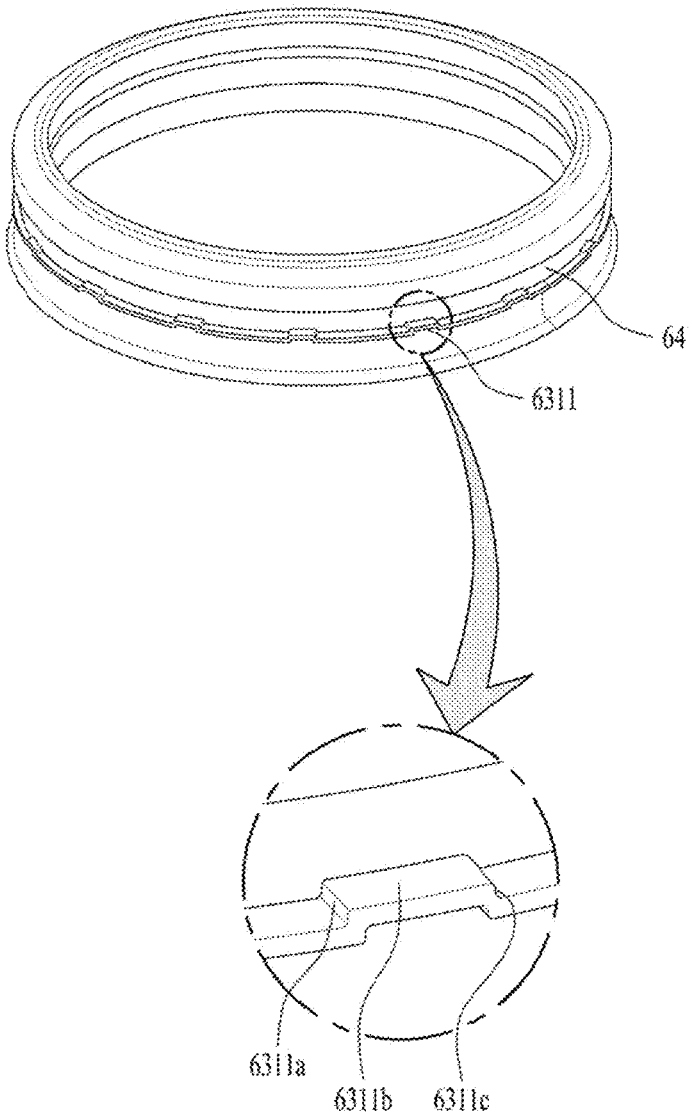
FIG. 2 is an enlarged view illustrating an example of a balancer and an example of a protrusion formed at a side surface of the balancer according to an embodiment of the present disclosure.

FIG. 2 illustrates the appearance in which at least one protrusion 6311 is arranged along the outer side surface of the housing 64 of the balancer 6, and the enlarged view of the protrusion 6311. As described above, the protrusion of the fastening part 63 may include a first contact part 6311*a*, a second contact part 6311*b*, and a third contact part 6311*c*. In more detail, the protrusion of the fastening part 63 may extend along the outer side surface of the housing 64 so that the first contact part 6311*a* may protrude upward from the housing 64. The second contact part 6311*b* may extend from the end of the first contact part 6311*a*, and may protrude in a direction parallel to the circumferential surface of the housing 64. The third contact part 6311*c* may extend from the end of the second contact part 6311*b*, may protrude in the height direction of the housing 64, and may thus contact the fastening part 63. In this case, during rotation, stoppage, and switching of the drum 4, the protrusion 6311 may protrude from the fastening part 63, so that slippage between the balancer 6 and the body 41 can be prevented.

Figure 3:
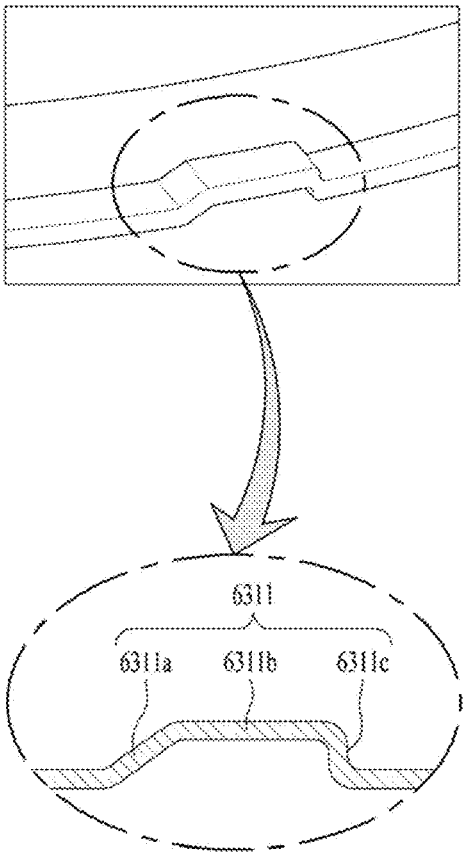
FIGS. 3 and 4 are enlarged views illustrating examples of a protrusion formed at a side surface of the balancer according to the present disclosure.
Figure 4:
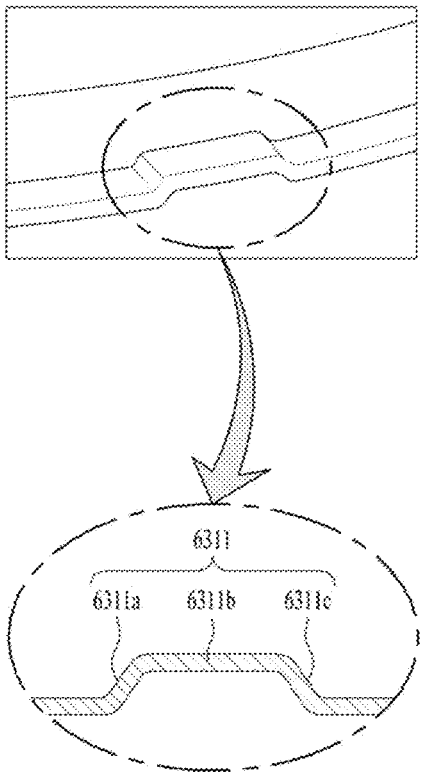

FIGS. 3 and 4 are enlarged views illustrating examples of the protrusion formed at a side surface of the balancer 6 according to the present disclosure. The first coupling part 4151 may be pre-molded to have a shape corresponding to the protrusion 6311, such that the first coupling part 4151 can be coupled in the corresponding shape. However, when the first coupling part 4151 is bent and coupled to the first fastening part 631 without pre-molding of the first coupling part 4151, the protrusion 6311 of the fastening part 63 is formed, resulting in formation of the shape corresponding to the protrusion shape of the first coupling part 4151. In this case, the fastening part 63 and the coupling part 4151 can be tightly connected to each other, the assembly process (fabrication based on roller rotation) capable of successively performing the above operations to reduce the assembly time may be applied to the first contact part and the third contact part, so that the first contact part and the third contact part can be deformed. Roller-based process will be described with reference to FIGS. 8 and 9. The first contact part 6311*a* corresponding to a portion in which the roller is inserted may be tilted upward so as to facilitate movement of the roller. In addition, the third contact part 6311*c* may also be tilted downward in consideration of movement of the roller moving in another direction opposite to the movement direction of the roller as needed.

Figure 5:
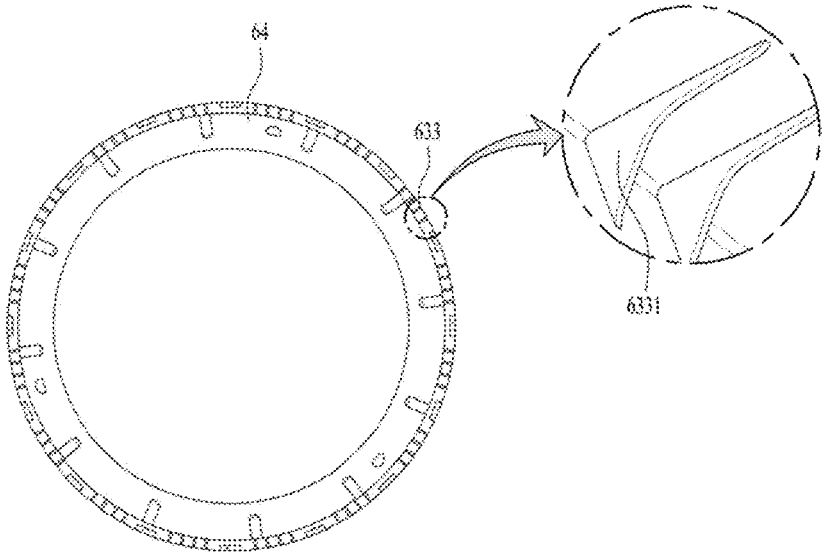
FIG. 5 illustrates a rear view of a balancer and an enlarged view of a reinforcement rib located at a side surface of the balancer according to the present disclosure.

If the coupling part 415 is bent toward a central direction of the housing 64 along the outer circumferential surface of the fastening part 63 and is coupled to the coupling part 415, force capable of bending the coupling part 415 is needed, such that the protruded fastening part 63 may be broken or damaged. In order to prevent such damage of the fastening part 63 and to increase rigidity of the fastening part 63, the bottom surface of the fastening part 63 (i.e., the third fastening part 633) may further include the reinforcement rib 6331. In more detail, the fastening part 63 may further include at least one reinforcement rib 6331 that contacts the third fastening part 633 and the housing 64 and protrudes from the housing 64 to the drum 4. FIG. 5 is an enlarged view illustrating an example of the reinforcement rib 6331 that is provided at a back surface of the balancer 6 and a side surface of the balancer 6. The reinforcement rib 6331 of FIG. 5 may be formed in a tapered shape. That is, as the distance from the reinforcement rib 6331 to the outside of a radial direction of the third fastening part 633 increases, the height of the reinforcement rib 6331 starting from the contact surface where the reinforcement rib 6331 contacts the third fastening part is gradually reduced, resulting in formation of a tapered shape.

Figure 6:
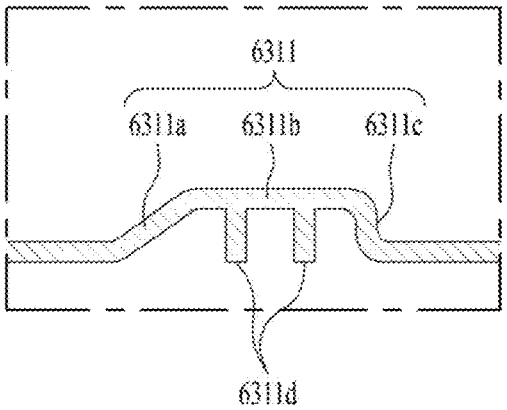
FIG. 6 illustrates an enlarged view of a protrusion formed at a side surface of the balancer and a cross-sectional view of a protrusion reinforcement rib according to the present disclosure.

FIG. 6 is an enlarged view illustrating the protrusion 6311 provided at a side surface of the balancer 6 and an example of the protrusion reinforcement rib 6311*d* when viewed in a contact surface between the protrusion 6311 and the housing 64. In a specific region in which the protrusion 6311 is contained, it is impossible for the housing 64 to have the same size as the reinforcement rib of the third fastening part 633 in which the protrusion 6311 is not contained. In order to prevent damage of the protrusion 6311, it is possible to use at least one reinforcement rib 6311*d* which contacts the second contact part 6311*b* and the housing 64 in a radial diameter direction by a predetermined length identical to or shorter than a length of the second contact part 6311*b* in a radial direction.

In addition, the protrusion reinforcement rib 6311*d* may include at least one protrusion reinforcement rib 6311*d* in which a maximum height from the surface contacting the second contact part 6311*b* to the lower end of the protrusion reinforcement rib 6311*d* is equal to or shorter than the height from the surface contacting the second contact part 6311*b* to the third fastening part 633 in which the protrusion 6311 is not contained. In this case, the height from the surface contacting the second contact part 6311*b* to the third fastening part 633 may refer to the distance from the surface contacting the second contact part 6311*b* to a virtual extension line of the third fastening part 633 of the region (having no protrusion) linearly extending downward from the protrusion reinforcement rib 6311*d*.

In addition, the protrusion reinforcement rib 6311*d* may include at least one protrusion reinforcement rib 6311*d* in the same manner as in the reinforcement rib 6331. In this case, the at least one protrusion reinforcement rib 6311*d* may be formed in a tapered shape. That is, as the distance from the protrusion reinforcement rib 6311*d* to the outside of a radial direction of the second contact part 6311*b* increases, the height of the protrusion reinforcement rib 6331*d* starting from the surface contacting the second contact part 6311*b* is gradually reduced, resulting in formation of the tapered shape.

In order to prevent slippage, only the first fastening part 631 may be formed to protrude toward the inlet 11 to result in formation of uneven parts, instead of using the entire fastening part bent to result in such uneven parts. The third fastening part unrelated to the protruded uneven parts of the first fastening part 631 may be arranged in a manner that all surfaces of the third fastening part are located at the same plane without change, so that the protrusion reinforcement rib 6311*d* may have the same shape as the reinforcement rib 6331.

Figure 7:
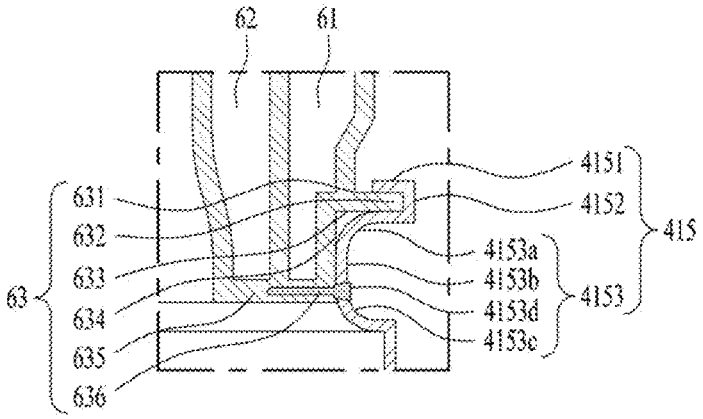
FIG. 7 is an enlarged view illustrating an example of a cross-sectional view of a connection between a fastening part of the balancer and a coupling part of the drum according to the present disclosure.

FIG. 7 is a cross-sectional view illustrating an example of a connection between the fastening part 63 and the coupling part 415. The coupling part 415 may be bent in a radial direction of the housing 64 along the outer circumferential surface of the fastening part 63 so that the coupling part of the coupling part 415 is broken or damaged. As a result, it may be necessary for the balancer 6 or the body 41 to be replaced with another. In this case, a screw-fastening part 636 may be provided to the fifth fastening part 635 so as to easily fix the balancer 6 to the body 41 without using such replacement. The planarization part 4153*b* of the third coupling part 4153 coupled to the fifth fastening part 635 may further include a screw hole 4153*d* formed to communicate with the screw-fastening part 636.

In still another embodiment, although not shown in the drawings, in order to fix the fastening part 63 and the coupling part 415 to each other, screws or rivets may be used to interconnect the first coupling part 4151 and the fastening part 63. Besides, other coupling methods for fixing the fastening part 63 to the coupling part 415 can also be applied as needed.

Figure 8:
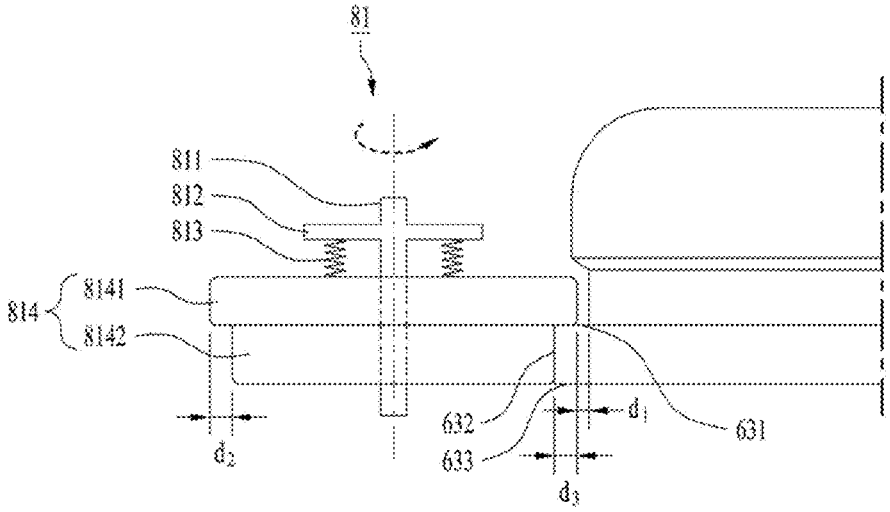
FIGS. 8 and 9 are schematic views illustrating a method for assembling a fastening part of the balancer to the coupling part of the drum according to the present disclosure.

FIG. 8 is a schematic view illustrating a method for assembling the fastening part 63 to the coupling part 415 according to the present disclosure. The coupling process in which the upper end of the body 41 is bent and coupled to the balancer 6 may include a first process and a second process. In the first process, the balancer 6 may be inserted into the upper end of the body. In the second process, the coupling part 415 may be bent toward a central direction of the housing 64 along the outer circumferential surface of the fastening part 63. Specifically, for continuous and stronger connection in the second process, the rolling process based on rotation of the first roller 81 may be used. In other words, the above-mentioned process may refer to a process in which the first coupling part 4151, the second coupling part 41521 or the third coupling part 4153 is bent and pressed during rolling of the first roller 81. By the above-mentioned process, the first coupling part 4151 may be molded with the shape of the protrusion 6311 formed in o the fastening part 63, such that the resultant first coupling part 4151 may be in closer contact with the fastening part 63. To this end, at least one roller may enter the same direction as the rotary shaft of the drum 4 in a manner that the coupling part 415 is bent to contact the third fastening part 633 and the second fastening part 632. The bent coupling part 415 may be bent again, so that the re-bent coupling part 415 may contact the first fastening part 631 in a manner that the first coupling part 415 is coupled to the fastening part 63. The above-mentioned processes may be sequentially or simultaneously performed by the rolling parts 8141 and 8142 of the head 814 of the first roller 81. When the above-mentioned processes are sequentially performed, the coupling part 415 may be bent using the first rolling part 8141, so that the end of the third fastening part 633 can be coupled to the second fastening part 632. Thereafter, when the first roller 81 moves toward the balancer 6, the coupling part 415 is coupled to the first fastening part 631 using the first rolling part 8141, and is re-coupled to the second fastening part 632 using the second rolling part 8142. In addition, the above-mentioned second step may be repeatedly performed using the first roller 81.

In addition, in order to evenly distribute the bending-coupling force of the first coupling part 4151 by the first roller 81, a roller support 812 may be provided to the rotary shaft 811 of the first roller 81, and the roller support 812 is coupled to the top surface of the roller head 814 through one or more springs, such that necessary force can be constantly transferred.

In addition, as described above, the length (d3) of the first coupling part 4151 is shorter than the length (d1+d3) of the first fastening part 631, such that damage of the housing 64 can be prevented in the second process due to the predetermined separation distance (d3), resulting in formation of the resultant coupling part 4151.

Figure 9:
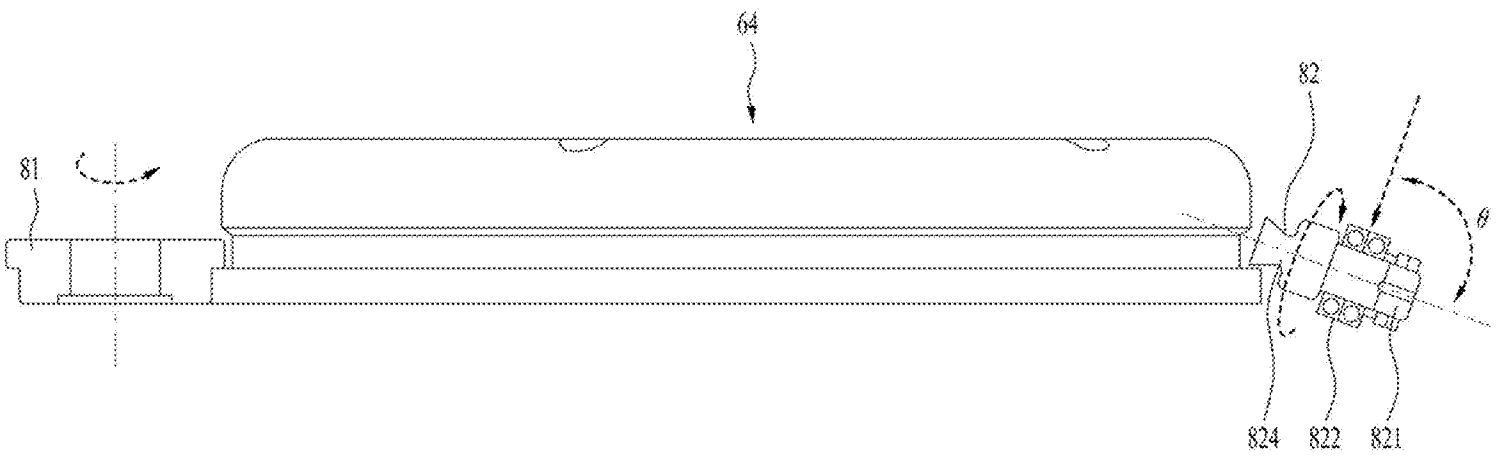

FIG. 9 is a schematic view illustrating a method for assembling the fastening part 63 to the coupling part 415 according to the present disclosure. When performing the second process using only one first roller 81, the fastening part 63 may not be easily coupled to the coupling part 415, so that the rolling process should be repeatedly performed, resulting in consumption of a long assembly time taken to perform such assembly process. As a result, the second processes should be simultaneously performed using several rollers. FIG. 9 illustrates an embodiment implemented using two rollers from among various assembly methods. Although two rollers are used in the embodiment of FIG. 9, the scope or spirit of the present disclosure is not limited thereto, and many more rollers can also be applied to the present disclosure as needed. The first roller 81 may enter the same direction as the rotary shaft of the drum 4 in a manner that the coupling part 415 is bent to contact the third fastening part 633 and the second fastening part 632. The resultant coupling part 415 may be re-bent to contact the first fastening part 631, such that the coupling part 415 can be coupled to the fastening part 63. In addition, the second roller 82 may enter in the direction diagonal to the rotary shaft of the drum 4, the first coupling part 4151 may be bent and coupled to the first fastening part 631 such that the first coupling part 4151 can more closely contact the first fastening part 631.

As is apparent from the above description, the laundry treatment apparatus according to the embodiments of the present disclosure may not couple the balancer to the upper end of the drum using one or more screws, may include a protrusion formed at an outer surface of the balancer, may bend the upper end of the drum, and may couple the bent upper end of the drum to the protrusion, resulting in formation of the laundry treatment apparatus.

The laundry treatment apparatus according to the embodiments of the present disclosure may include a balancer formed by deformation (redesigning) of the protrusion so as to prevent the protrusion of the balancer from being damaged by problems encountered when the balancer is coupled to the upper end of the drum according to the above-mentioned bending-coupling method. For example, the above problems may include slippage caused by rotation, stoppage, switching or vibration of the drum due to loose connection between the balancer and the upper end of the drum, and damage of the protrusion of the balancer due to occurrence of bending-and-coupling force.

The embodiments of the present disclosure may provide an assembly method for bending the upper end of the drum to be suitable for the outer surface of the balancer using a roller in a manner that the bent upper end of the drum is coupled to the outer surface of the balancer, and may also provide a laundry treatment apparatus using the assembly method.

In a situation in which damage or malfunction of connection between the balancer and the upper end of the drum occurs so that the balancer and the upper end of the drum are not fixed, the laundry treatment apparatus according to the embodiments of the present disclosure can be used without replacement of the balancer or the drum.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A laundry treatment apparatus comprising:

a cabinet that defines an inlet;

a tub disposed in the cabinet and configured to receive water, the tub defining a tub opening configured to communicate with the inlet of the cabinet;

a drum comprising a body rotatably disposed in the tub and configured to receive laundry, the body defining a body through-hole that passes through the body and a drum opening configured to communicate with the tub opening;

a balancer disposed vertically above the drum, the balancer comprising:

a housing that has a ring shape, the housing defining a circulation passage configured to circulate fluid along a circumference of the housing and a housing through-hole that passes through the housing and that is in communication with the drum opening and the tub opening, and a fastening part arranged along an outer circumferential surface of the housing and coupled to the body; and a coupling part that is disposed at an upper end of the body of the drum, that is coupled to the fastening part along an outer circumferential surface of the fastening part, and that is curved or bent toward a central direction of the housing, wherein the fastening part comprises at least one protrusion that protrudes from a top surface of the fastening part and that is configured to restrict slippage between the fastening part and the coupling part, and wherein the at least one protrusion comprises:

a first contact part that extends upward from the top surface of the fastening part along a height direction of the housing, a second contact part that extends from an end part of the first contact part along a circumferential direction of the housing, and a third contact part that extends downward from an end part of the second contact part along the height direction of the housing and connects to the top surface of the fastening part.

2. The laundry treatment apparatus according to claim 1, wherein:

the fastening part protrudes outward from the outer circumferential surface of the housing in a radial direction of the housing and is accommodated in the upper end of the body of the drum; and the coupling part is bent inward to the fastening part in the radial direction of the housing and extends along the outer circumferential surface of the fastening part.

3. The laundry treatment apparatus according to claim 2, wherein the fastening part comprises:

a first fastening part disposed at the top surface of the fastening part;

a second fastening part disposed at a side surface of the fastening part;

a third fastening part disposed at a bottom surface of the fastening part;

a fourth fastening part that extends downward from an inner end of the third fastening part toward a bottom surface of the housing; and a fifth fastening part that extends radially inward from an end of the fourth fastening part to the bottom surface of the housing, wherein the coupling part comprises:

a first coupling part that contacts the first fastening part, a second coupling part that extends downward from the first coupling part and that contacts the second fastening part, and a third coupling part that extends from the second coupling part and that contacts the third fastening part, the fourth fastening part, and the fifth fastening part, the third coupling part comprising:

a first curved part that contacts the third fastening part and the fourth fastening part, a planarization part that extends downward from the first curved part and that contacts the fifth fastening part, and a second curved part that extends from the planarization part and that connects to the body of the drum.

4. The laundry treatment apparatus according to claim 3, wherein an end part of the first coupling part extends toward the outer circumferential surface of the housing in the radial direction of the housing and is spaced apart from the outer circumferential surface of the housing by a separation distance.

5. The laundry treatment apparatus according to claim 4, wherein the fastening part and the coupling part are in surface-contact at least one of at an interface between the first fastening part and the first coupling part, at an interface between the second fastening part and the second coupling part, or at an interface between the fifth fastening part and the planarization part.

6. The laundry treatment apparatus according to claim 5, wherein the first curved part has a curved shape, and wherein a first end of the first curved part contacts the third fastening part, and a second end of the first curved part contacts the fourth fastening part.

7. The laundry treatment apparatus according to claim 6, wherein the fastening part has a shape corresponding to a shape of the first coupling part.

8. The laundry treatment apparatus according to claim 3, wherein the first contact part is inclined upward with respect to the top surface of the fastening part and connects to the second contact part.

9. The laundry treatment apparatus according to claim 8, wherein the third contact part is inclined downward with respect to the second contact part and connects to the top surface of the fastening part.

10. The laundry treatment apparatus according to claim 9, further comprising:

at least one reinforcement rib that protrudes from the third fastening part toward the drum, that is configured to support the fastening part, and that is connected to the outer circumferential surface of the housing.

11. The laundry treatment apparatus according to claim 10, wherein at least one the reinforcement rib has a tapered shape, and wherein a height of the at least one reinforcement rib with respect to the third fastening part decreases as the at least one reinforcement rib extends outward in the radial direction toward an inner circumferential surface of the tub.

12. The laundry treatment apparatus according to claim 11, wherein the at least one protrusion comprises:

at least one protrusion reinforcement rib that protrudes downward from a lower surface of the second contact part and that is configured to support the at least one protrusion, and wherein at least one protrusion reinforcement rib extends to the housing in the radial direction by a predetermined length that is less than or equal to a radial length of the second contact part.

13. The laundry treatment apparatus according to claim 12, wherein a height of the at least one protrusion reinforcement rib with respect to the lower surface of the second contact part is less than or equal to a distance between the lower surface of the second contact part and a lower surface of the third fastening part.

14. The laundry treatment apparatus according to claim 13, wherein the height of the at least one protrusion reinforcement rib with respect to the lower surface of the second contact part decreases as the at least one protrusion reinforcement rib extends outward in the radial direction toward the inner circumferential surface of the tub.

15. The laundry treatment apparatus according to claim 14, further comprising at least one screw-fastening part configured to pass through the fifth fastening part and to couple the coupling part to the fastening part.

16. The laundry treatment apparatus according to claim 15, wherein the coupling part defines at least one screw-hole that passes through the planarization part and is configured to receive with the at least one screw-fastening part.

* * * * *